United States Patent [19]

Langlitz et al.

[11] 4,254,711

[45] Mar. 10, 1981

[54] METALLURGICAL VESSEL HANDLING VEHICLE

[75] Inventors: Karlheinz Langlitz, Mulheim; Günter Schmitz, Duisburg, both of Fed. Rep. of Germany

[73] Assignee: Mannesmann Demag A.G., Fed. Rep. of Germany

[21] Appl. No.: 66,027

[22] Filed: Aug. 13, 1979

[51] Int. Cl.[3] ..... B61F 3/04; B61F 5/00; B61F 13/00

[52] U.S. Cl. ..... 105/177; 266/165; 414/663

[58] Field of Search ..... 105/177; 266/165; 414/663

[56] References Cited

U.S. PATENT DOCUMENTS

| | | | |
|---|---|---|---|
| 2,889,597 | 6/1959 | Griffiths | 105/177 X |
| 3,312,544 | 4/1967 | McCready et al. | 105/177 X |
| 3,434,606 | 3/1969 | Asamura | 105/177 X |
| 3,593,859 | 7/1971 | Spanning et al. | 105/177 X |
| 3,715,101 | 2/1973 | Puhringer | 105/177 X |
| 3,718,265 | 2/1973 | Trost | 266/165 X |
| 3,918,682 | 11/1975 | Despalmes | 105/177 X |

FOREIGN PATENT DOCUMENTS

| | | | |
|---|---|---|---|
| 2008396 | 9/1971 | Fed. Rep. of Germany | 105/177 |

*Primary Examiner*—Howard Beltran
*Attorney, Agent, or Firm*—Mandeville and Schweitzer

[57] ABSTRACT

The invention refers to a transport exchange truck for changing and alternating metallurgic vessels, particularly for steel mill converters. The truck is provided with an interior frame part arranged to rotate in the center of the exterior carriage frame with at least one piston—supportable on the mill floor—of a piston-cylinder unit to raise the exterior frame part carrying the undercarriages. The exterior frame part supports a lift table which can be raised or lowered by means of one or several piston-cylinder units. Each piston rod is connected with the lift table through at least one ball-and-socket joint whose joint housing is provided with articulated traction elements.

13 Claims, 8 Drawing Figures

METALLURGICAL VESSEL HANDLING VEHICLE

BACKGROUND AND DESCRIPTION OF THE INVENTION

Such vessel exchange trucks are used to transport metallurgic vessels with worn brick linings, for example, from the vessel stand to a brick lining stand, and back. To this end, it is necessary to detach the vessel from its rigging. The rigging in metallurgical plants consists of many different configured items including tilting frames, annular supports, pivot arms, casting devices, and the like. The transport of the vessel takes place on rails which cross. The carriage frame is lifted off the track at crossings, turned by 90°, and replaced on the other track. The present invention uses for this purpose pistons located in the center of the carriage frame for engaging the ground. While lift pistons, arranged at the carriage ends, are well known, the latter, however, require a long stroke as the carriage together with the vessel must be lifted up to operating position of the vessel.

Mounts for the metallurgical vessel vary greatly. The type of mounts on which the invention is based requires a lift table lifting the vessel into guides which have become untrue due to the heat of operation, or due to wear and tear. The lift table adapts to the inaccuracy by means of the mentioned inserted ball-and-socket joints, and/or traction elements articulated by means of ball-and-socket joints.

It has been disclosed in U.S. Pat. No. 3,718,265 to balance these inaccuracies by an individual adjustment of the lift table according to height and incline by arranging at each corner of the rectangular carriage frame lift devices in pairs, bearing Cardan or universal joints, at the ends of which the cylinders are attached, and by additional Cardan joints provided at the traction elements forming a connection with a bridge carrying the vessel. In this design, the traction elements may shift in the form of a parallelogram, whereby the lift devices maintain their perpendicular position. While the adaptability of the two spaced bridges forming the support for the lift table meets the requirements desired in operation, the system of the "bridge" leads to a relatively great structural width and structural length of the vessel exchange truck. The usual vessel exchange truck, therefore, necessitates a wide rail track which is abnormal.

The present invention provides vessel exchange trucks which are equipped with compact lift devices for a flexibly arranged lift table, as well as in view of the arrangement of the joint system for the lift table. The carriage is more narrow than before and runs on tracks of normal width. It is lighter and, with minor structural changes, may be used for small or large metallurgical vessels.

This problem is solved by the truck of the invention by first determining the plan outline of the vessels to be supported, and positioning the piston-cylinder units providing the lift for the lift table around the circumference of the plan outline. In addition, the guiding elements which provide traction for the lift table are hinged thereto and extend below the table a length equal to the piston-cylinder units. The guiding elements are hinged, in turn, at their lower ends to intermediate elements extending from the area of the support bearing surface of the vessels to be supported, and rigidly connected thereto.

Accordingly, the invention provides lift devices arranged closer than usual to the center of the vessel exchange truck. This arrangement in the center under the vessel ordinarily would lead to a very high structure. This problem is solved by the invention by means of the mentioned intermediate elements forming a stiff connection with the bearings, and to which the traction elements are hinged. This hinged arrangement extends into recessed areas of the carriage frame and is a decided saving in structural height. The use of traction elements whose cross section can receive great tractive or tensile forces, contributes to diminish the structural width.

The length of the traction elements is at the same time a way of increasing the adaptability of the support bearings to a warped vessel surface. In the sense of a greater adaptability, longer traction elements have the effect of increasing the horizontal displacement movement of the lift table. The vessel exchange truck of the invention is built in compact form in conjunction with the divided arrangement of the piston-cylinder units and traction elements and by using relatively small cross sections, as well as using the length of the traction elements. The compact construction provides a smaller width so that exchange truck can run on the normal track width of a conventional metallurgical plant rail track. Furthermore, due to the construction by the invention, there are considerable savings in weight and this construction is suitable for large as well as for small metallurgical vessels.

In further development of the basic concept of the invention, the intermediate elements consist of supports extending downward from the lift table, and are coordinated with the piston-cylinder units which are arranged spaced around the circumference of the lift table. Favorably, the lengths of the intermediate elements match approximately the lengths of the traction elements so that a considerable saving in structural height is achieved. Furthermore, the stress on the intermediate support element is manifested as buckling stress, and the stress on the traction element is manifested as tensile stress. Thus, the piston rods of the piston-cylinder units are only subject to tensile stress. Such piston-cylinder units are less expensive, and less heavy for longer piston travels.

The intermediate elements or links according to this invention are arranged so that the supports extending down from the lift table are of forked design. One piston-cylinder unit each is arranged within the space embraced by the fork. This arrangement also represents a saving in the truck's structural height.

Another modification of the positioning system of the invention is that the intermediate elements consist of yoke-shaped U-frames resting on the joint housings of the piston rods. This provides a two-way flexibility for the lift table support or the bearing points forming the lift table so that an even better adjustment to the contact points is reached when inserting the vessel. The invention presupposes that the lift table is elastically deformed under the load of the vessel which may amount to several hundred tons. This deformation may very easily be compensated for on account of the twofold flexibility. This adaptability to the insertion of the vessel into the bearing surface of the lift table is increased when sufficient space is left between the U-shaped frames of the intermediate elements and the related joint housing of the piston rod to allow play therebetween. The independence of individual bearing points can also be cancelled by providing a rigid interconnection between all U-frames by means of rods in the shape of a polygon.

For vessels whose rigging is provided at two opposing sides on the vessel circumference, it is advantageous if the piston-cylinder units are arranged with the intermediate elements at the longitudinal sides of the carriage forming entrance openings.

Another arrangement of the lift device and/or the guiding system of the invention is that the lift elements, flexibly attached to the intermediate elements, are hinged at their upper ends to a cross rail on a guide column displaceable within a guide housing and located centrally of the lift device. This arrangement also guarantees not only a narrow construction of the vessel exchange truck, but also the desired horizontal displacement of the lift table and/or its bearing points in an area of approximately 30–70 mm. The guide column, displaceable within a guide housing, may consist of a piston-cylinder unit. The structural height of the lift table is furthermore reduced when the guide column, which is displaceable within the guide housing, consists of a telescopic piston-cylinder unit.

According to further details of the invention the traction elements themselves may consist of piston-cylinder units with the cylinder housing and the piston rod each provided with a ball-and-socket joint. For the guiding system which, according to the type described, only results in a horizontal displacement motion of the lift table in the area of about 30 to 70 mm, and for such steering systems according to the invention for which a dual adaptation flexibility is considered advantageous, provision is made that the bearings supporting the metallurgical vessel consist of short-stroke piston-cylinder units arranged on the lift table and/or the U-frames coordinated with the piston-cylinder units.

Furthermore, an extremely low structural height of the vessel exchange truck is achieved by providing the interior frame portion with vertical recesses for the intermediate elements extending down from the lift table and/or piston-cylinder units.

Examples of the invention are shown on the drawings and explained as follows:

DETAILED DESCRIPTION OF THE INVENTION

Figure 1:
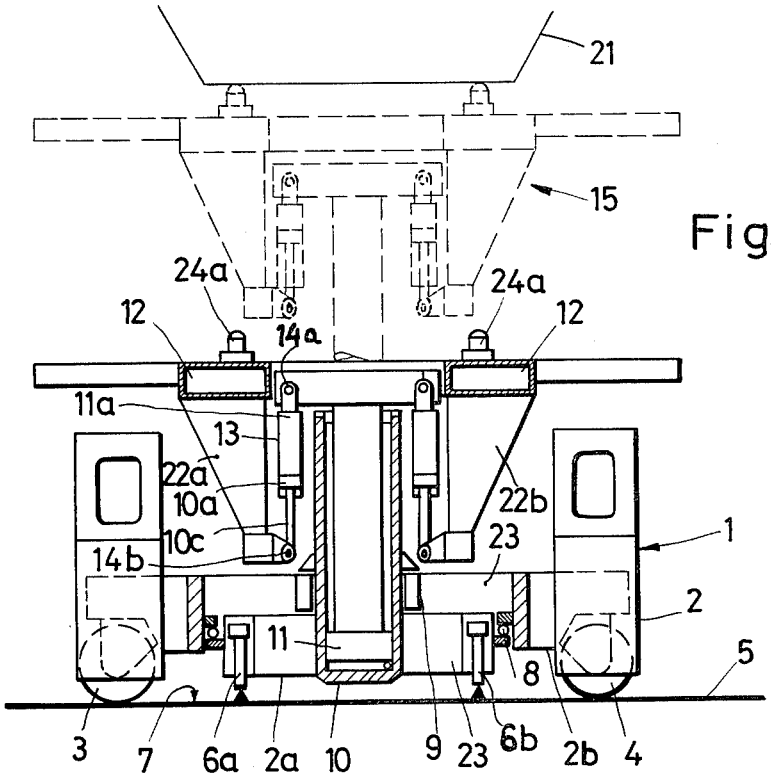
FIGS. 1–4 are each a vertical longitudinal sectional view of four different embodiments illustrating the vessel exchange truck of the invention.

The vessel exchange truck 1 according to the invention consists of the carriage frame 2 with an interior frame portion 2*a*, and exterior frame portion 2*b*, supporting itself on the undercarriages 3 and 4. The vessel exchange truck 1 runs on rails 5. These rails 5 have a track width of about 4,300 mm. Contrary to this the usual vessel exchange trucks run on rails with tracks having a width of about 6,200 mm. The interior frame portion 2*a* carries extendible pistons 6*a*, 6*b*, which may be supported on the surface 7 of the mill floor adjacent to the rails, whereby the interior frame portion 2*a* lifts the exterior frame portion 2*b*. In the raised position, the exterior frame portion 2*b* may be rotated into a new rail direction around the interior frame portion 2*a* by rotary bearings 8, by means of a rotary drive (not shown) which is of no consequence for an understanding of the invention.

Figure 2:
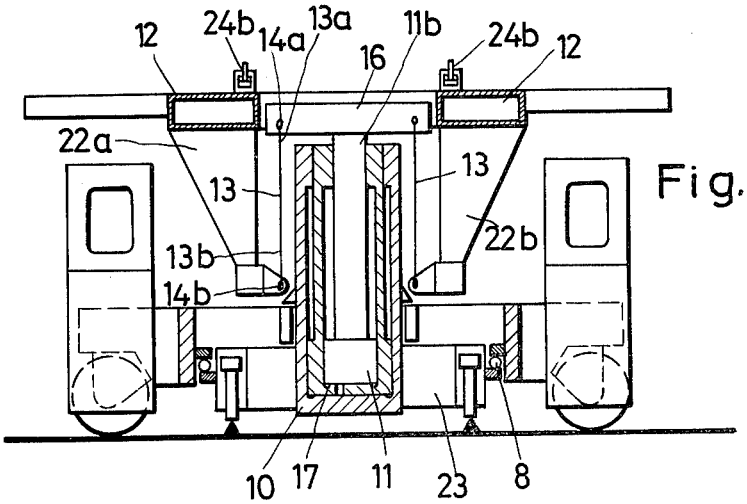

The cylinder 10 for the piston 11 is supported in the hub 9 on the exterior frame part 2*b*. The cylinder 10 and the piston 11 form a piston-cylinder unit, and support the lift table 12 via traction elements 13. The traction elements 13 in FIG. 1 are three piston-cylinder units, whose individual cylinders are arranged on the base support plan of the embodiment in the corners of a triangle. There may, however, also be four or more traction elements 13. Generally, each piston-cylinder unit 10, 11 arranged eccentrically is coordinated with a traction element 13. Each piston-cylinder unit 10, 11 carries a ball-and-socket joint 14. The ball-and-socket joint 14 is located in most cases, according to FIGS. 1 through 4, at the traction elements 13. As shown in FIG. 2, each traction element 13 is provided with a ball-and-socket joint 14*a* at the upper end 13*a* and with a ball-and-socket joint 14*b* at the lower end 13*b*. The traction elements 13 may, as shown in FIG. 1, simultaneously be designed as a piston-cylinder unit with the piston 10*a*, and the cylinder 11*a*. In the typical design according to FIG. 1, the piston in the cylinder 10, as well as the piston 10*a*, in the cylinder 11*a* may be charged with a pressure fluid.

During the lifting process, the piston-cylinder 10, 11 are activated first, and the pistons 10*a* in the cylinders 11*a* are activated only after the highest possible lift or stroke of piston 11. The entire lift is advantageously extremely high, as may be seen in FIG. 1 from the lift position designated 15 shown in broken line, without relinquishing the effect of control of the steering system of the traction elements 13.

According to the embodiment of FIG. 2, the traction elements 13 are not provided with the dual function of traction rods or stabilizer bars and as piston-cylinder units simultaneously. Rather they are formed as traction rods alone, which are hinged to the cross rail 16 of the piston rod 11*b* by means of the ball-and-socket joints 14*a*, 14*b*.

Figure 3:
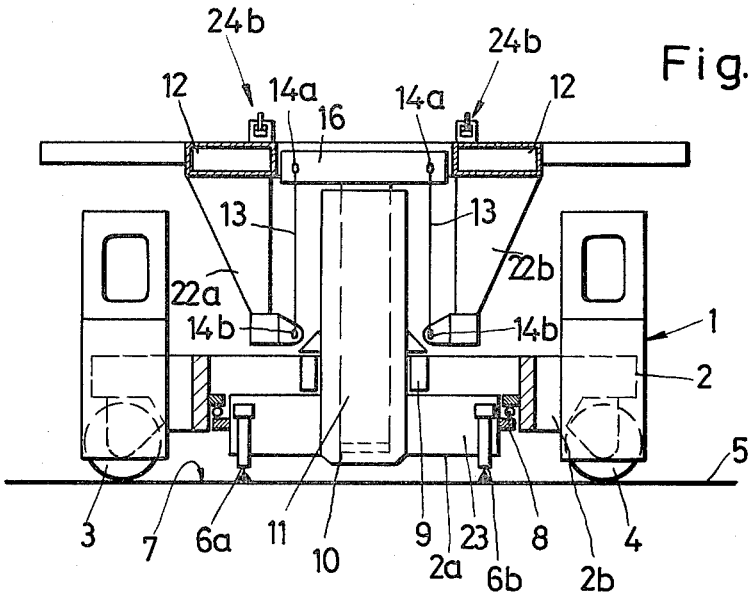

The piston-cylinder unit 10, 11 in the embodiment shown in FIG. 2 is a telescopic piston-cylinder unit 10, 11, 17, whereby the piston 11 in the cylinder 17 acts at first as a first lift stage. In the second lift stage, the cylinder 17 forms the piston itself with its outer form in the cylinder 10. The piston 10 in the cylinder 11 of FIG. 3 represents the only lift drive in this embodiment. The traction elements 13 are designed as guide and stabilizer rods or tubes.

Figure 4:
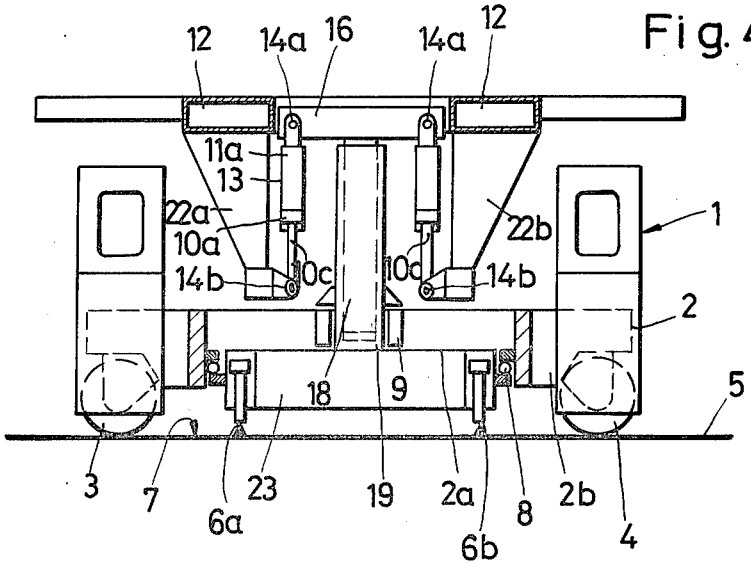

The embodiment of FIG. 4 provides a guide column 18 and a guide housing 19, which act solely as a vertical guide and which do not operate with a pressure fluid. The lift devices consist of the pistons 10*a* and the cylinders 11*a* acting simultaneously as traction elements 13.

Figure 5:
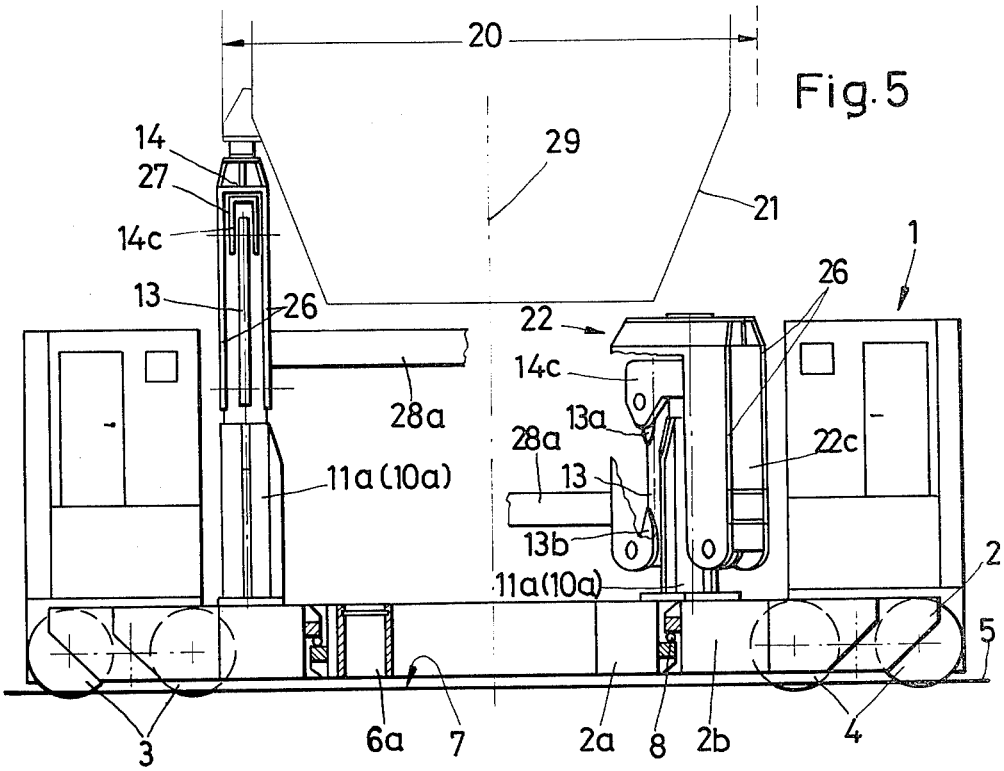
FIG. 5 is a vertical longitudinal sectional view of a further embodiment illustrating the invention.

All piston-cylinder units 10, 11 and/or 10*a*, 11*a* are arranged on an approximately circular base support plan extending to a width as shown at 20 in FIG. 5 which is roughly the diameter of vertically positioned vessel body 21. This measure, which is basically disadvantageous for the operating and structural height of the lift table 12, is partially compensated for by intermediate elements 22 (22*a*, 22*b*) extending from the lift table 12 downward. In a vessel exchange truck of extremely low construction, the intermediate elements 22 extend into recesses 23 (FIGS. 1–4) of the interior frame part 2*a*. The intermediate elements 22 are rigidly attached to the lift table 12.

Figure 6:
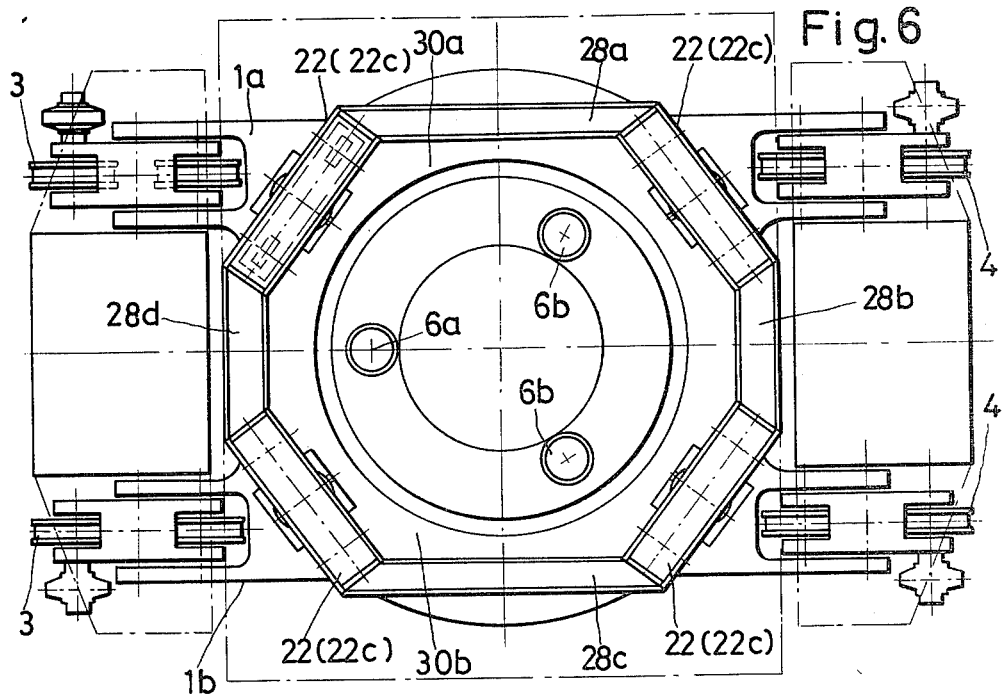
FIG. 6 is a plan view of the apparatus of FIG. 5 showing the arrangement of support mechanisms therein.
Figure 7:
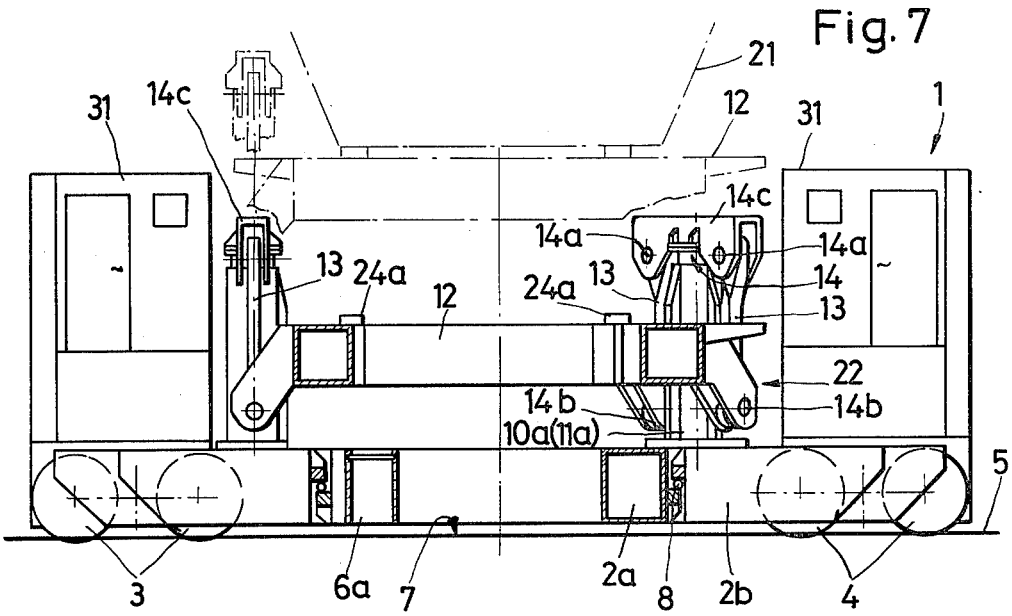
FIG. 7 is a vertical longitudinal sectional view of a further embodiment illustrating the invention.
Figure 8:
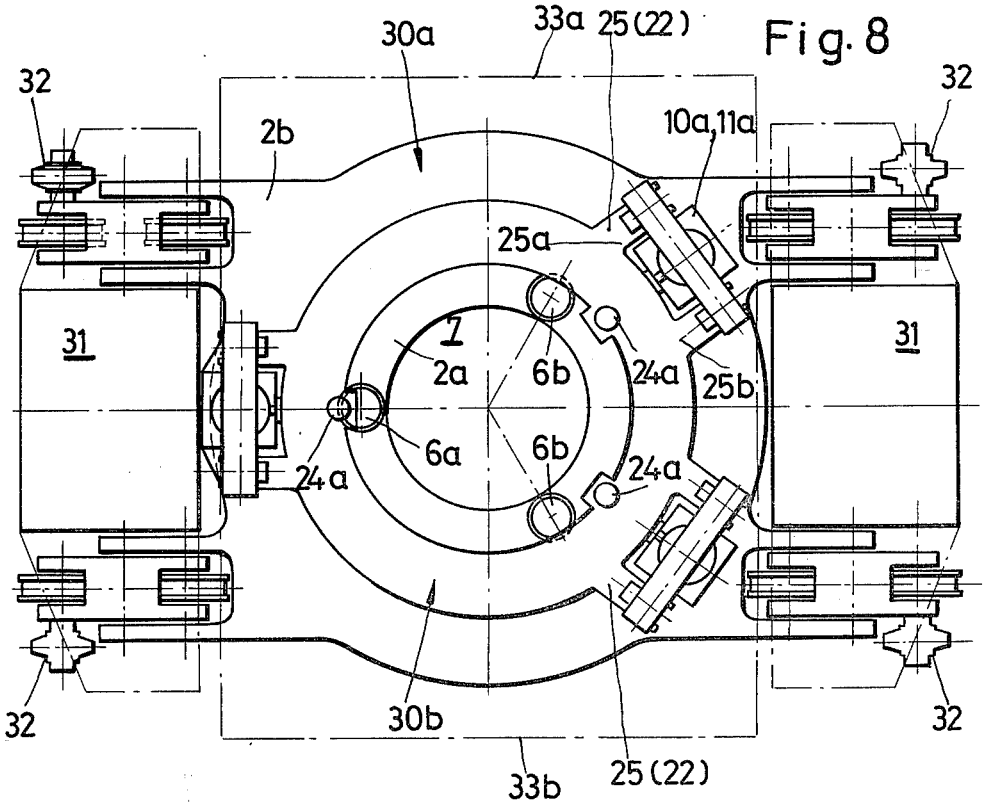
FIG. 8 is a plan view of the apparatus of FIG. 7 showing the arrangement of support mechanisms therein.

The term "lift table" includes all the bearing supports and pedestals engaging and supporting the vessel during the exchange, and/or during transport thereof. Consequently, the "lift table" may include an annular bearing, such as one made up of an infinite number of bearing points as shown in FIGS. 1–4 or of four bearings as shown in FIGS. 5 and 6. However, there will be at least three bearings, as shown in FIGS. 7 and 8. In FIGS. 1 through 4, the bearings 24 consist of rings accommodating trestles 24*a* or short-stroke piston-cylinder units 24*b*. The short-stroke piston-cylinder units 24*b* permit additional unilateral lift movements, if the adaptation of the vessel 21 to greater inaccuracies of the vessel rigging requires such movements.

The intermediate elements 22 are formed as supports 22*a*, 22*b*, at whose lower ends the ball-and-socket joints 14*b* of the traction elements 13 are to be found. The supports 22, according to FIGS. 7 and 8, form forks 25. The piston-cylinder units 10*a*, 11*a* are arranged in the teeth 25*a*, 25*b* of forks 25 in a space-saving layout.

Diverging from the typical designs of FIG. 1 through 4, the exterior frame part 2*b* accommodates individually arranged piston-cylinder units 10, 11. Within the joint housing 14*c*, there is in each case another ball-and-socket joint 14, not shown, connected with the piston rod 10*c* of the piston-cylinder unit 10, 11. The connection includes a ring preventing the dropping out of the ball. The joint housing 14*c* rests on the ball. The traction elements 13 are hinged as described. The ends 13*a* and 13*b* make the connection, by means of the ball-and-socket joints 14*a* at the top and 14*b* at the bottom, to the intermediate element 22 consisting of the U-frame 22*c*. The U-frame 22*c* form a housing 26 open at the bottom. The housing 26 surrounds the joint housing 14*c* with clearance 27 (FIG. 5), so that there is a gap between the U-frame 22*c* and the joint housing 14*c*, permitting a displacement of the U-frames 22*c*. The displacement of the four U-frames 22*c* indicated in FIGS. 5 and 6 takes place at the same time, as all U-frames 22*c* are rigidly interconnected by means of the rods 28*a*, 28*b*, 28*c*, and 28*d*. In this way they form the adaptable lift table 12.

In FIG. 5, the sides to the left and to the right of the axis of symmetry 29 are shown in the raised position (left) and in the lowered position (right). In the arrangement of the piston-cylinder units (10*a*, 11*c*) according to FIG. 6 (as well as according to FIG. 8) entrance openings 30*a* and 30*b* are formed on the longitudinal truck sides 1*a* and 1*b*.

The lift table 12 may be annular as shown in FIGS. 7 and 8, as has already been mentioned, and may carry the intermediate elements 22 which are angular with legs extending toward the bottom. In this case, the extremely low construction of the vessel exchange truck 1 can be realized by means of the recesses 23, by providing the latter in the exterior frame part 2*b*. As is illustrated by FIGS. 7 and 8, the necessary height of the lift table 12 reaches approximately the height of the control room 31 (indicated in broken line). The structural height of the vessel exchange truck 1 is therefore considerably lower than that of the conventional vessel exchange truck where the piston-cylinder units protrude considerably beyond the control room cabin.

The vessel exchange truck is equipped with drive motors 32 arranged on the axles at the undercarriages 3 and 4. The lift table 12 is laterally provided with entrance openings 30*a*, and/or 30*b* and working platforms 33*a* and 33*b*. Instead of the piston-cylinder units 10, 11 and 10*a*, 11*a*, threaded spindle-threaded nut hoisting gears may be utilized as well as will be understood. Necessary reduction gears and the necessary electromotors or oil motors producing a rotary motion are firmly attached to the exterior carriage frame 2*b*, and if necessary by inserting universal joint (Cardan) shafts.

We claim:

1. A transport vehicle for metallurgical vessels, comprising (a) a carriage frame;

(b) rail engaging wheels on said carriage frame;

(c) an interior frame rotatably mounted on said carriage frame;

(d) ground engaging fluid pressure means on said interior frame for lifting said frame from said rails;

(e) a lift table on said vehicle for receiving metallurgical vessels therein;

(f) second fluid pressure means on said exterior frame for raising and lowering said lift table;

(g) means connecting said second fluid pressure means to said lift table, said connecting means including at least one ball-and-socket joint means connected to an articulated stabilizer support means; the improvement characterized by (h) said second fluid pressure means positioned within a base support space defined by the diameter of a vessel to be supported;

(i) said connection means includes a plurality of spaced apart intermediate connection elements in said base support space and rigidly connected to said lift table and extending below said lift table;

(j) said stabilizer support means includes a plurality of cooperating stabilizers in said base support space and extending between said second fluid pressure means and said intermediate connection elements;

(k) the top of each stabilizer support means connected to the top of said fluid pressure means;

(l) the bottom of each stabilizer support means connected to the bottom of said cooperating intermediate connection elements; and (m) said top and bottom connections of said stabilizer support means being said ball-and-socket means.

2. The apparatus of claim 1, further characterized by (a) a plurality of spaced abutments on said lift table;

(b) said spaced abutments forming the circumferentially arranged bearing receiving surface for metallurgical vessels placed thereon; and (c) each said spaced abutment is a short-stroke pressure fluid piston-cylinder unit.

3. The apparatus of claim 1, further characterized by (a) a plurality of spaced apart vertical recesses on said interior frame; and (b) said interior recessed receiving said vertical intermediate connections in the lower position of said lift table.

4. The apparatus of claim 1, further characterized by (a) said second fluid pressure means includes a plurality of spaced apart cooperating fluid pressure means with each positioned adjacent one said intermediate connection element.

5. The apparatus of claim 4, further characterized by
(a) said plurality of spaced apart pressure fluid means and adjacent intermediate connection elements are positioned at each end of said base support space;
(b) whereby access openings are provided at each longitudinal side of said vehicle.

6. The apparatus of claim 4, further characterized by
(a) each said intermediate connection element is fork shaped;
(b) each cooperating second fluid pressure means is positioned within said fork.

7. The apparatus of claim 6, further characterized by
(a) each said intermediate connection including a yoke-shaped U-frame;
(b) each U-shaped frame positioned to rest upon said top ball and socket means.

8. The apparatus of claim 7, further characterized by
(a) each said ball-and-socket means including a housing; and
(b) each yoke-shaped U-frame positioned over said housing with a spacing to allow for play therebetween.

9. The apparatus of claim 7, further characterized by
(a) a connecting rod extending between each said U-frame; and
(b) said connecting rods fixed at each end thereof to the said adjacent U-frame.

10. The apparatus of claim 9, further characterized by
(a) said connected together U-frames and connecting rods forming said lift table.

11. The apparatus of claim 4, further characterized by
(a) a vertical guide housing disposed centrally upon said interior frame;
(b) a guide column vertically reciprocal in said guide housing;
(c) a cross rail fixed on the top of said guide column;
(d) said second fluid pressure means forming a part of each said spaced apart stabilizer support means; and
(e) said top ball-and-socket connection is to said cross rail.

12. The apparatus of claim 11, further characterized by
(a) said guide housing and said guide column are a third fluid pressure means.

13. The apparatus of claim 12, further characterized by
(a) said third fluid pressure means is a pressure fluid operated telescopic assembly.

* * * * *